US008109798B2

(12) United States Patent
Sun et al.

(10) Patent No.: US 8,109,798 B2
(45) Date of Patent: Feb. 7, 2012

(54) ELECTRICAL CONNECTOR WITH IMPROVED RECEIVING CHANNELS LATCHED WITH CONTACTS

(75) Inventors: Yun-Song Sun, Kunshan (CN); Song-Liang Wang, Kunshan (CN); Chien-Hsun Huang, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/015,289

(22) Filed: Jan. 27, 2011

(65) Prior Publication Data

US 2011/0195608 A1 Aug. 11, 2011

(30) Foreign Application Priority Data

Feb. 8, 2010 (CN) ..... 201020302584

(51) Int. Cl.
*H01R 13/40* (2006.01)

(52) U.S. Cl. ..... 439/733.1; 439/660

(58) Field of Classification Search ..... 439/660, 439/862, 733.1
See application file for complete search history.

(56) References Cited

U.S. PATENT DOCUMENTS 3,596,234 A * 7/1971 Sapienza et al. ..... 439/682
4,645,279 A * 2/1987 Grabbe et al. ..... 439/68
5,263,882 A * 11/1993 Peterson ..... 439/733.1
6,616,485 B2 * 9/2003 Harasawa et al. ..... 439/630
6,905,371 B2 * 6/2005 Yi-Tse ..... 439/660
6,976,888 B2 * 12/2005 Shirai et al. ..... 439/862
7,297,010 B2 * 11/2007 Tsai ..... 439/331
7,377,789 B1 * 5/2008 Liu ..... 439/66

FOREIGN PATENT DOCUMENTS

CN 2547034 4/2003

* cited by examiner

*Primary Examiner* — Tho D Ta
(74) *Attorney, Agent, or Firm* — Wei Te Chung; Andrew C. Cheng; Ming Chieh Chang

(57) ABSTRACT

An electrical connector (100), comprising an insulative housing (1) and a plurality of contacts (2) received in the insulative housing. The insulative housing defines a base portion (11) and a mating portion (12) in front of the base portion, the mating portion defines a plurality of receiving channels (124) extending along a mating direction. The contacts are received in the insulative housing, and inserted into the receiving channels along a front-to-back direction. Each contact has a soldering portion (21) extending through the receiving channel and assembled to the base portion of the insulative housing, a retaining portion (23) located in front of the soldering portion and held in the receiving channel, and a contacting portion (24) received in the mating portion of the insulative housing, the retaining portion has a higher barb (231) in the front and a lower barb (232) on a rear section thereof on both sides.

9 Claims, 5 Drawing Sheets

ELECTRICAL CONNECTOR WITH IMPROVED RECEIVING CHANNELS LATCHED WITH CONTACTS

BACKGROUND OF THE INVENTION

1. Field of the Invention

The present invention generally relates to an electrical connector, and more particularly to an electrical connector used for an electronic equipment.

2. Description of Related Art

CN patent No. 2547034Y issued to Huang on Apr. 23, 2003 discloses a plug connector comprising an insulated housing and a plurality of contacts, and the insulated housing has a plurality of receiving grooves, the contacts are assembled into the insulated housing along a rear-to-front direction. The contacts are retained in the corresponding receiving grooves via a latch of each contact locked in a corresponding fixing hole of the insulated housing, and the latch is arranged on a top surface of a U-shaped retaining portion of each contact, each fixing hole is arranged in an upper surface of the corresponding receiving groove, so the contacts can be prevented sliding backwards. However, the contacts will be pulled backwards constantly as the plug connector mated frequently, so the latch may be destroyed and the contacts may move rearwards to separate from the insulated housing.

Hence, it is desirable to have an improved structure to overcome the above-mentioned disadvantages of the prior art.

BRIEF SUMMARY OF THE INVENTION

Accordingly, the object of the present invention is to provide an electrical connector with a plurality of contacts retained in an insulative housing stably.

In order to achieve the above-mentioned object, an electrical connector in accordance with the present invention comprises an insulative housing and a plurality of contacts received in the insulative housing. The insulative housing defines a base portion and a mating portion in front of the base portion, the mating portion defines a plurality of receiving channels extending along a mating direction. The contacts are received in the insulative housing, and inserted into the receiving channels along a front-to-back direction. Each contact has a soldering portion extending through the receiving channel and assembled to the base portion of the insulative housing, a retaining portion located in front of the soldering portion and held in the receiving channel, and a contacting portion received in the mating portion of the insulative housing, the retaining portion has a higher barb in the front and a lower barb on a rear section thereof on both sides.

Other objects, advantages and novel features of the invention will become more apparent from the following detailed description of the present embodiment when taken in conjunction with the accompanying drawings.

DETAILED DESCRIPTION OF THE INVENTION

Figure 1:
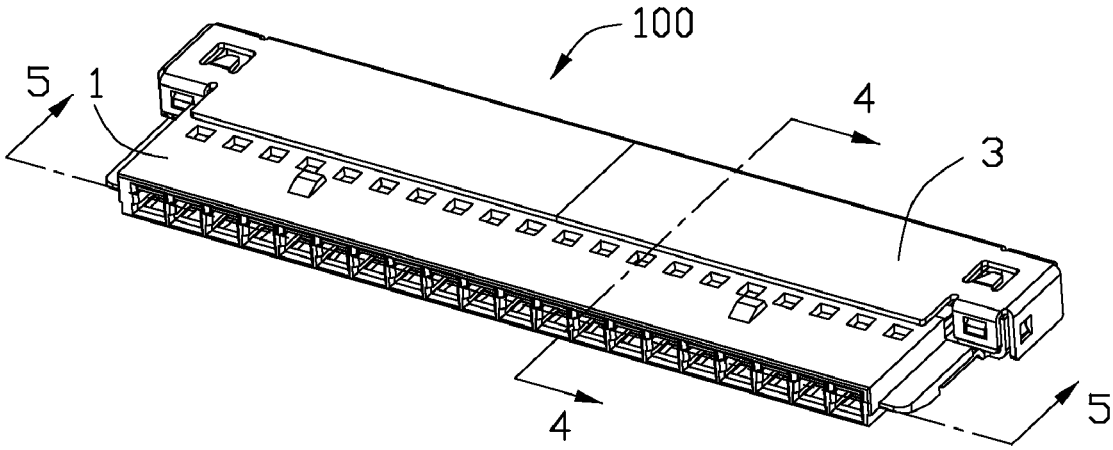
FIG. 1 is an assembled, perspective view of an electrical connector in accordance with the present invention.

Reference will now be made to the drawing figures to describe the present invention in detail.

Referring to FIGS. 1-5, an electrical connector 100 made in accordance with the present invention comprises an insulative housing 1, a plurality of contacts 2 received in the insulative housing 1 and a metallic shell 3 shielding the insulative housing 1.

Figure 2:
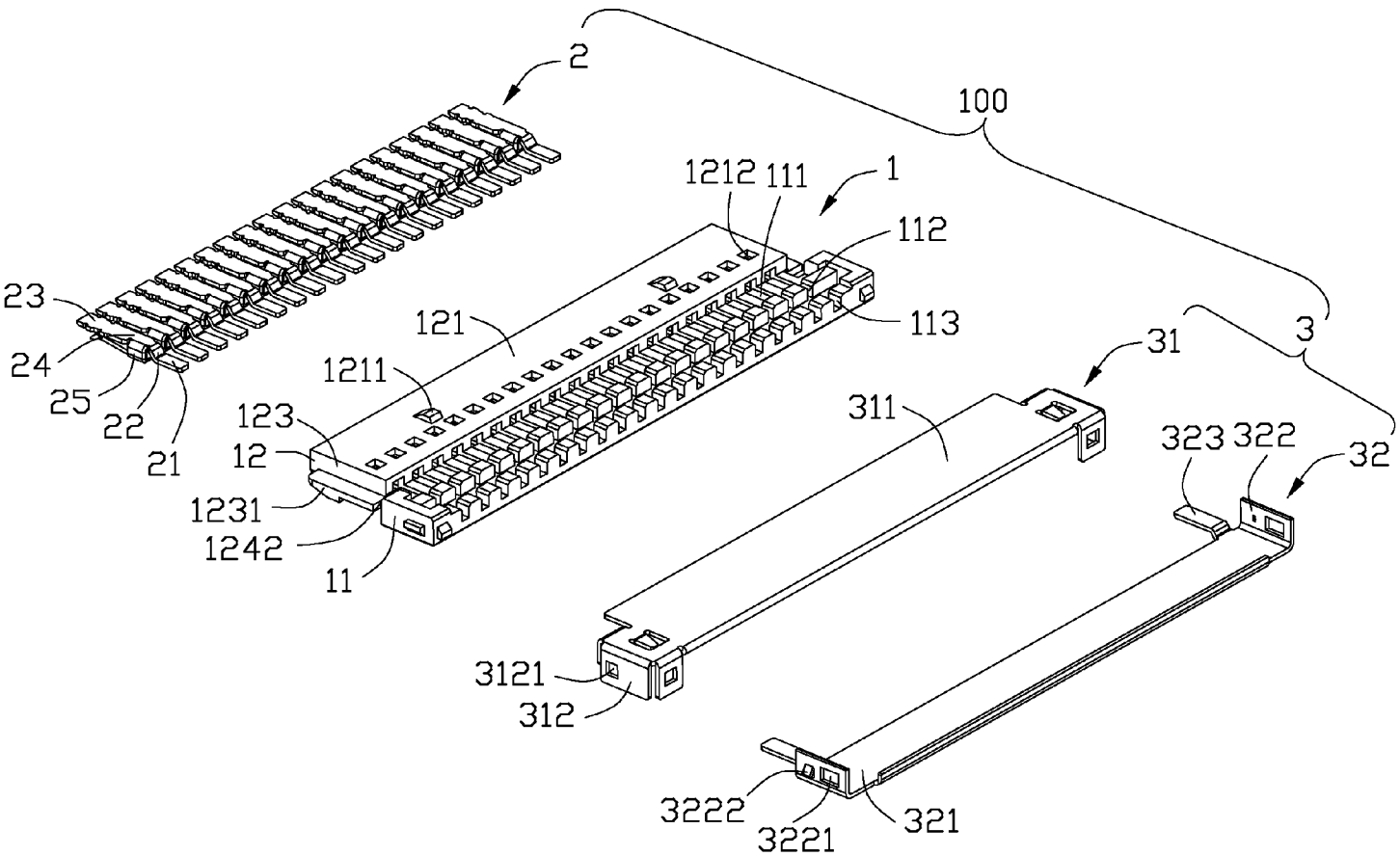
FIG. 2 is an exploded, perspective view of the electrical connector shown in FIG. 1.
Figure 3:
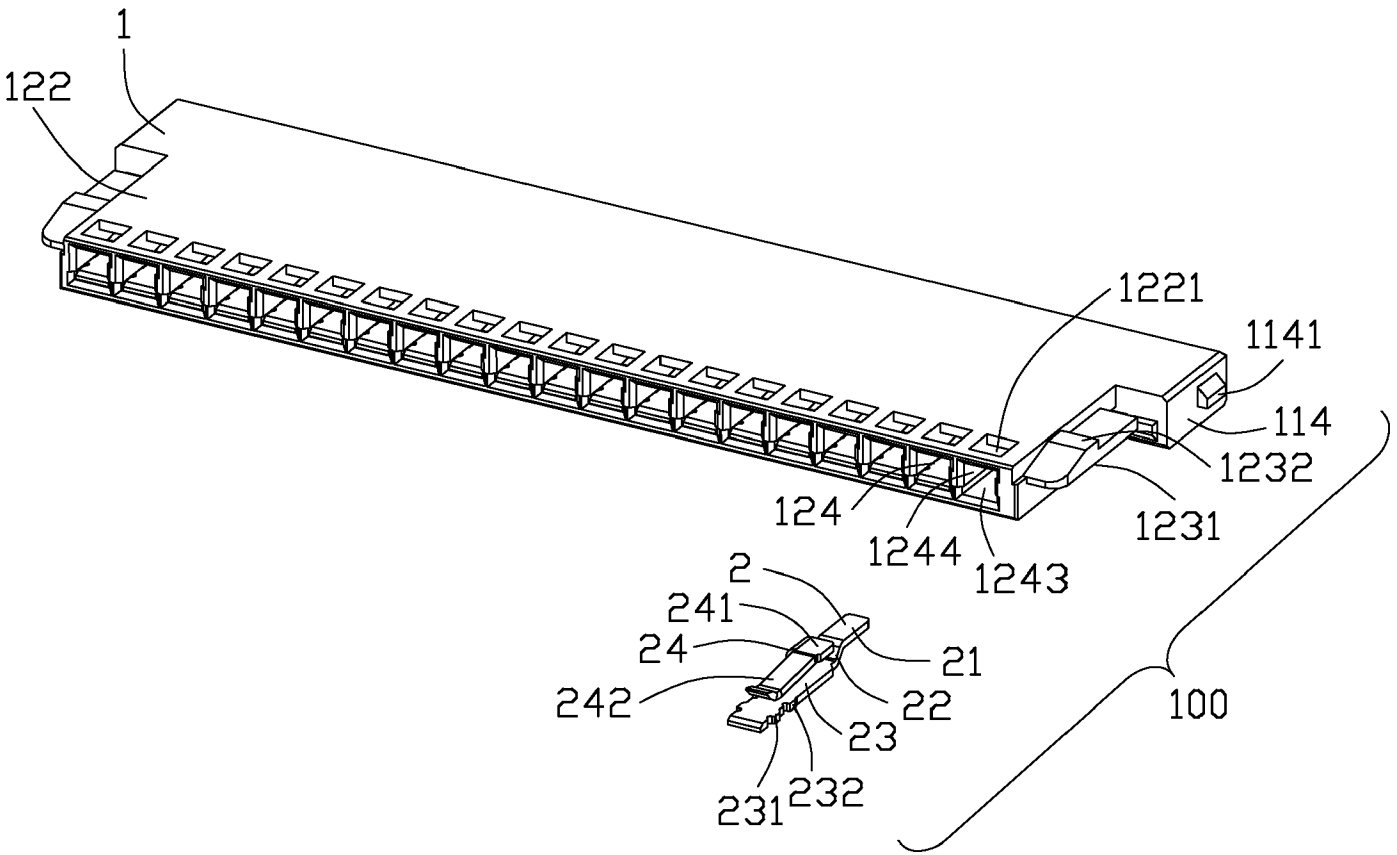
FIG. 3 is a partially assembled, perspective view of an insulative housing with a plurality of contacts of the electrical connector.
Figure 4:
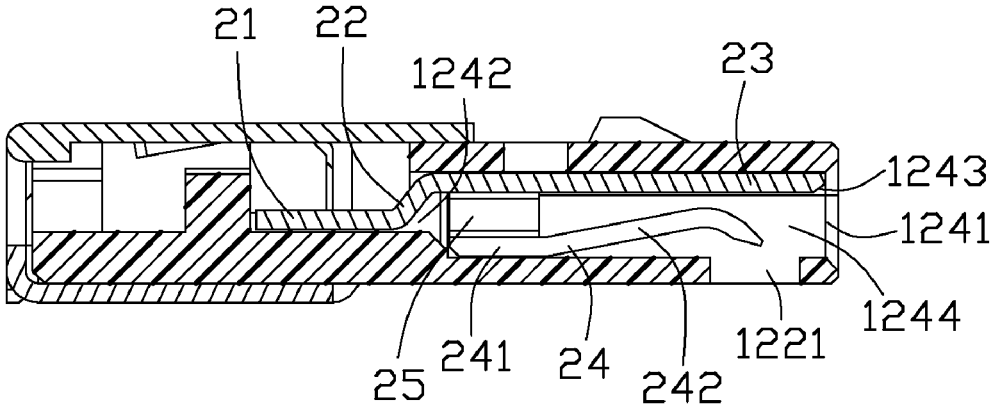
FIG. 4 is a cross-section view take along line 4-4 of FIG. 1.
Figure 5:
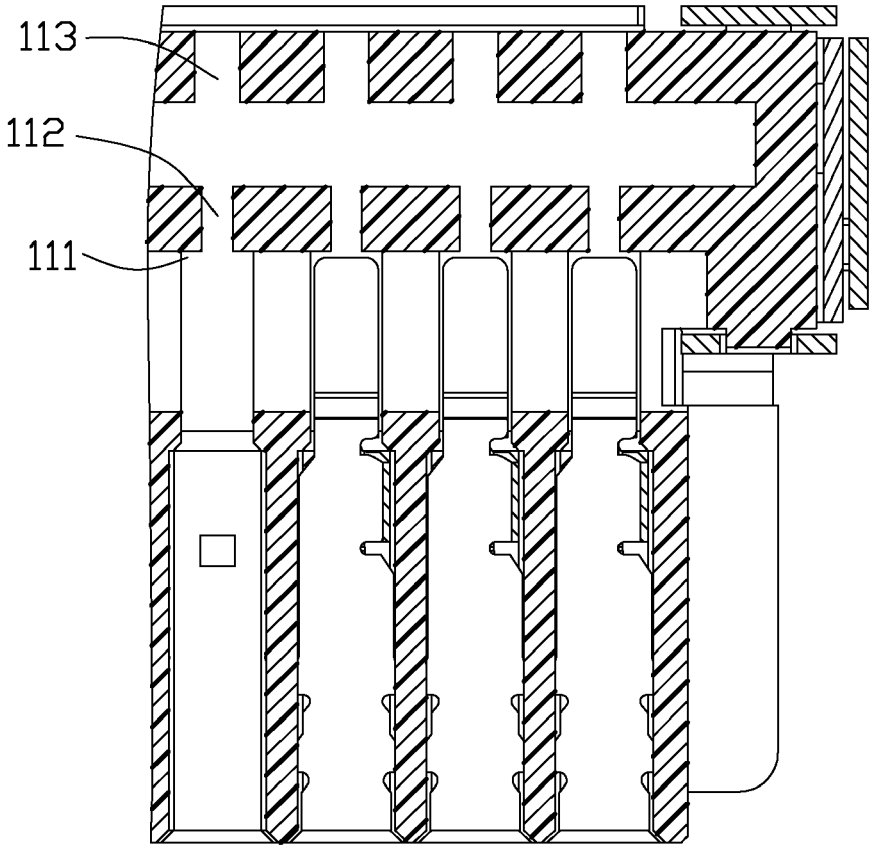
FIG. 5 is a partially cross-section view take along line 5-5 of FIG. 1, with one of the contacts being drawn out.
Figure 5:
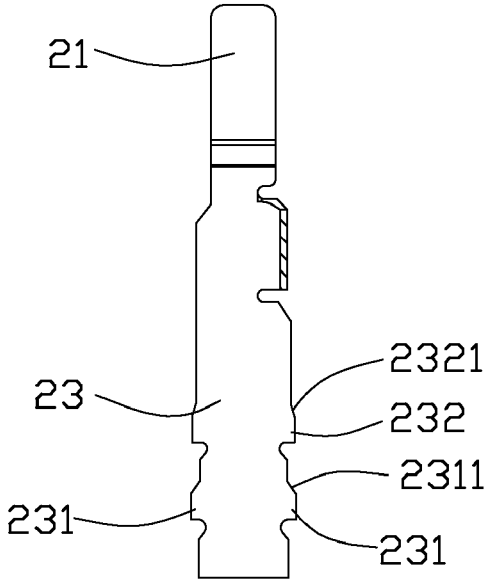

Referring to FIGS. 2-3, the insulative housing 1 is of a unitary configuration, and includes a base portion 11 and a mating portion 12 extending forwards from the base portion 11 to mate with a complementary connector (not shown). The mating portion 12 is configured with a plate approximately, and comprises an upper wall 121, a lower wall 122, a pair of lateral walls 123 and a plurality of receiving channels 124 extending along a mating direction, the receiving channels 124 are arranged in a row along a transverse direction. The upper wall 121 has a pair of wedges 1211 protruding upwards and a plurality of slots 1212 communicated with corresponding receiving channels 124. The lower wall 122 defines a number of grooves 1221 communicated with corresponding receiving channels 124. Each lateral wall 123 defines a leading member 1231 to guide the electrical connector 100 mating with the complementary connector. The leading member 1231 has a protrusion 1232 to achieve anti-mismating and latching performance.

Each receiving channel 124 is formed with a plurality of internal walls (not labeled), and comprises a first opening 1241 and a second opening 1242 back to back, the first opening 1241 is arranged towards foreside with the second opening 1242 towards backside. The first opening 1241 is of convex shape, and the second opening 1242 is rectangular, the second opening 1242 has a smaller dimension than the first opening 1241. Each receiving channel 124 also defines a first notch 1243 and a second notch 1244 below the first notch 1243, and the first notch 1243 has a bigger width than the second notch 1244. The base portion 11 is elongate in a transverse direction, and defines a plurality of rectangular passages 111 relative to the receiving channels 124, a plurality of first routeways 112 and a plurality of second routeways 113, and the first routeways 112 is narrower than the second routeway 113. The base portion 11 defines a pair of mounting portions 114 on lateral sides, and each mounting portion 114 defines at least one of wedge-shaped extruding portion 1141.

Each contact 2 is made of metallic material, and comprises a soldering portion 21 connected with a wire (not shown) and extending horizontally, a linking portion 22 extending slantways from the soldering portion 21, a retaining portion 23 extending horizontally from the linking portion 22, a contacting portion 24 below the retaining portion 23 and a rectangular bridge 25 connecting the contacting portion 24 and the retaining portion 23. The contacting portion 24 is spaced apart from the retaining portion 23, and the bridge 25 is disposed along a vertical direction. The retaining portion 23 defines a pair of first barbs 231 on both sides thereof and a pair of second barbs 232 behind the first barbs 231, each second barb 232 has a smaller width than the first barb 231. Additionally, each of the first barbs 231 and the second barbs 232 respectively has an inclined surface 2311, 2321, and each inclined surface 2311, 2321 has a higher front portion and a lower rear portion, therefore can guide the contacts 2 being inserted into the receiving channels 124, and the contacts 2 can be retained in the insulative housing 1 via the first barbs 231 and the second barbs 232 interferentially cooperated with the receiving channels 124.

The contacting portion 24 comprises a rear section 241 parallel to the retaining portion 23 and an elastic mating section 242 extending forwards from the rear section 241, and the mating section 242 is curved and firstly extending close to the retaining portion 23, and then away from the retaining portion 23. The retaining portion 23 and the contacting portion 24 are mating with contacts of the complementary connector together. The retaining portion 23 has a bigger width than the soldering portion 21, the linking portion 22, the contacting portion 24 and the second opening 1242 of the receiving channel 124. The bridge 25 is connecting the retaining portion 23 with the rear section 241 of the contacting portion 24. The contact 2 has the same height with the first opening 1241, and has a bigger height than the second opening 1242.

The metallic shell 3 is die casted from metal material, and comprises a top shell 31 and a bottom shell 32. The top shell 31 defines a first plane portion 311 and a plurality of vertical walls 312 bending downwards from the first plane portion 311, and each vertical wall 312 has a through hole 3121. The bottom shell 32 defines a second plane portion 321, a pair of side walls 322 extending upwards from both sides of the second plane portion 321, and a pair of arms 323 extending from a front edge of the second plane portion 321. The arms 323 are neighboring to the corresponding side walls 322, and each side wall 322 has a cutout 3221 and a tab 3222.

In assembly, the contacts 2 are inserted into the receiving channels 124 along the mating direction from the first opening 1241 of the insulative housing 1 firstly, and the soldering portion 21 of each contact 2 is extending through the receiving channel 124 and accommodated in the rectangular passage 111 of the base portion 11. Each bridge 25 is adjacent to an inner wall of the receiving channel 124, and each retaining portion 23 is received in the first notch 1243, the first barbs 231 and the second barbs 232 are interferentially matched with the receiving channels 124, so the retaining portions 23 can be held in the receiving channel 124. The contacting portions 24 are received in the second notches 1244, and the rear sections 241 of the contacting portions 24 are adjacent to corresponding inner walls of the receiving channels 124, the mating sections 242 are located above the relative grooves 1221. Secondly, the wires (not shown) are soldered to the soldering portions 21 of the contacts 2 and extending through the first routeways 112 and the second routeways 113 of the base portion 11.

In the third step, the metallic shell 3 is assembled to the insulative housing 1, and the bottom shell 32 is enclosing the base portion 11 of the insulative housing 1, the second plane portion 321 is adjacent to a lower surface of the base portion 11, the side walls 322 are adjacent to external sides of the mounting portions 114 of the base portion 11. The cutouts 3221 are latched with the corresponding extruding portions 1141 of the mounting portions 114, the arms 323 of the bottom shell 32 are adjacent to the protrusions 1232 of the leading members 1231. The top shell 31 is assembled to the insulative housing 1, and the first plane portion 311 is shielding on the base portion 11, the vertical walls 312 are covering the mounting portions 114 of the base portion 11 and the side walls 322 of the bottom shell 32, the through holes 3121 of the vertical walls 312 are latched with the corresponding extruding portions 1141 of the mounting portions 114 and the tabs 3222 of the bottom shell 32.

In the present invention, the contacts 2 are assembled into the insulative housing 1 along a front-to-back direction, and the contacts 2 can be held in the insulative housing 1 still stably while pulling the wires, and the electrical connector 100 doesn't need a complex latch mechanism locking with an insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a base portion and a mating portion in front of the base portion, the mating portion defining a plurality of receiving channels extending along a mating direction; and a plurality of contacts received in the insulative housing, and being inserted into the receiving channels along a front-to-back direction; wherein each contact has a soldering portion extending through the receiving channel and assembled to the base portion of the insulative housing, a retaining portion located in front of the soldering portion and held in the receiving channel, and a contacting portion received in the mating portion of the insulative housing, the retaining portion has a higher barb in the front and a lower barb on a rear section thereof on both sides;

wherein the contacting portion is elastic, the retaining portion is stiff and above the contacting portion, each contact also comprises a bridge connecting the retaining portion with the contacting portion and a linking portion combining the soldering portion with the retaining portion, the bridge is adjacent to an inner wall of the receiving channel, and the linking portion is extending slantways from the soldering portion.

2. The electrical connector as claimed in claim 1, wherein each receiving channel defines a first opening towards foreside and a second opening towards backside, the first opening has a bigger dimension than the second opening.

3. The electrical connector as claimed in claim 1, wherein each receiving channel comprises a first notch and a second notch narrower than the first notch, and the second notch is arranged below the first notch and communicated with the first notch, the retaining portion is extending horizontally and received in the first notch.

4. The electrical connector as claimed in claim 3, wherein the barbs are interferentially held in the receiving channels, and divided into a first barb and a second barb behind the first barb, the second barb has a smaller width than the first barb in a transverse direction.

5. The electrical connector as claimed in claim 4, wherein contacting portion is received in the second notch, and comprises a rear section parallel to the retaining portion and an elastic mating section extending forwards from the rear section, the rear section is adjacent to an inner wall of the receiving channels, and the mating section is curved and firstly extending close to the retaining portion, and then away from the retaining portion.

6. The electrical connector as claimed in claim 5, wherein the bridge is connecting the retaining portion with the rear section of the contacting portion, and has a bigger height than the second opening.

7. The electrical connector as claimed in claim 6, wherein the retaining portion has a bigger width than the soldering portion, the contacting portion and the second opening of the receiving channel, the contact has the same height with the first opening, and has a bigger height than the second opening.

8. The electrical connector as claimed in claim 7, wherein the base portion of the insulative housing has a plurality of passages communicated with the receiving channels, and the soldering portions are received in the corresponding passages.

9. An electrical connector comprising: an insulative housing defining a plurality of passageways extending therethrough in a front-to-back direction, each of said passageways essentially defining a pair of opposite first walls in a vertical direction, and a pair of opposite second walls;

a plurality of contacts disposed in the corresponding passageways, respectively, each of said contacts including a main body essentially intimately extending along one of the first walls in a parallel relation, and a resilient curved contacting section extending forwardly proximate the other of the first walls, a linking section connecting between the main body and the contacting section and located proximate one of the second walls, and a tail section directly unitarily extending from a rear end of the main body while in an offset manner and proximate the other of the first walls; wherein a retention structure is formed around a front end of the main body;

wherein a front end of the resilient curved contacting section is located behind the retention structure in said front-to-back direction.

* * * * *